United States Patent [19]

Racz

[11] 4,150,821

[45] Apr. 24, 1979

[54] TENNIS TRAINING DEVICE

[76] Inventor: Gabor B. Racz, 255 Robineau Rd., Syracuse, N.Y. 13207

[21] Appl. No.: 818,513

[22] Filed: Jul. 25, 1977

[51] Int. Cl.[2] ..... A63B 69/38

[52] U.S. Cl. ..... 273/29 A; 273/73 R

[58] Field of Search ..... 273/29 A, 29 R, 183 B, 273/189 R, 189 B, 75, 73 R, 191 R, 191 B, 54 B, 188 R, 190 B, 190 A, 185 C, 67 C, 162 R, 81, 192, 194 R, 193 A, 260; 2/16, 161 A; 272/71

[56] References Cited

U.S. PATENT DOCUMENTS

| | | | |
|---|---|---|---|
| 350932 | 10/1886 | Keating | 272/71 |
| 563,578 | 7/1896 | Emerson | 272/71 |
| 3,858,881 | 1/1975 | Hurwitz | 273/29 A |

FOREIGN PATENT DOCUMENTS

| | | | |
|---|---|---|---|
| 2449360 | 4/1976 | Fed. Rep. of Germany | 273/29 A |
| 205442 | 10/1923 | United Kingdom | 273/75 |

OTHER PUBLICATIONS

Sporting Goods Dealers, Sept. 1976.

*Primary Examiner*—William H. Grieb
*Assistant Examiner*—T. Brown
*Attorney, Agent, or Firm*—Bruns & Jenney

[57] ABSTRACT

A tennis training aid that also operates to reduce the likelihood of developing tennis elbow. The training aid is comprised of a flexible strap that extends from a fitting on the head of the player's racquet to a member engaging his wrist. The fitting is attached to the racquet head at approximately its widest transverse point. The connecting strap is an aid in establishing a desired angular relation between the player's arm and the longitudinal axis of the racquet. At the same time, the connecting strap minimizes the possibility of stretching or overextending the extensor muscles of the players's forearm which stretching frequently leads to the injury known as tennis elbow.

7 Claims, 4 Drawing Figures

TENNIS TRAINING DEVICE

BACKGROUND OF THE INVENTION

This invention relates generally to athletic equipment and has particular reference to a novel device for teaching tennis, the device also being operable to reduce the likelihood of tennis elbow.

Many tennis instructors believe that the head of the racquet should be positioned above the player's wrist when hitting ground strokes and volleys. This means that the angle between the player's forearm and the long axis of the racquet will be from 90° to something greater than 90° but less than 180°. To hold the racquet in this manner is often difficult for beginning tennis players who have not had a sufficient amount of practice and may also lack the required muscular development.

Various devices have been proposed for helping a beginning player to hold the racquet in the proper manner. Two such devices are disclosed in U.S. Pat. Nos. 3,693,973 to W. H. Wattenburg and 3,858,881 to Hurwitz. The Wattenburg trainer is a totally inflexible, splint-like device that most novices would find very difficult to use.

The Hurwitz device, which is the closest prior art known to the applicant, is less restrictive than the Wattenburg trainer but its effectiveness is doubtful. The Hurwitz device is primarily for preventing tennis elbow and the stated objective of properly holding the tennis racquet is secondary. The device comprises an elestic cord that is looped around the racquet handle and extends from that point to a ring on a known type of adjustable compression band that is worn on the player's forearm. The connection with the racquet handle is not sufficiently positive to offer any real support in maintaining the proper positioning of the racquet, and the forearm band can slip or shift position. If the band is pulled so tight that it cannot shift, it will probably cut off the circulation in the player's arm.

SUMMARY OF THE INVENTION

The tennis training device of the present invention effectively assists the player in holding the racquet so that the desired angular relation between his arm and the longitudinal axis of the racquet is established and maintained. At the same time, the device retards continued forward and inward movement of the racquet after the ball has been hit and thereby minimizes the tendency to stretch the extensor muscles of the forearm which can cause tennis elbow.

The device comprises a flexible strap that preferably has limited elasticity, a fitting positively secured to the head of the racquet to which one end of the strap is connected, and a member engaging the player's wrist to which the other end of the strap is connected. The fitting is detachably secured to the racquet frame at approximately the widest part of the head. The wrist engaging member can be a strong band or a portion of a glove.

The strap helps the player hold the racquet in the desired angular relation to his arm and, as noted above, also retards continued forward and inward movement of the racquet after the ball has been hit. In hitting hard shots and in serving, the initial impact is largely absorbed by the elasticity of the strap and thereafter the force of the impact is transmitted to the strong bone structure of the wrist. Since the strap in its preferred form ceases to have elasticity beyond a certain point, it operates to limit the stretching of the forearm muscles.

DESCRIPTION OF THE PREFERRED EMBODIMENTS

Figure 1:
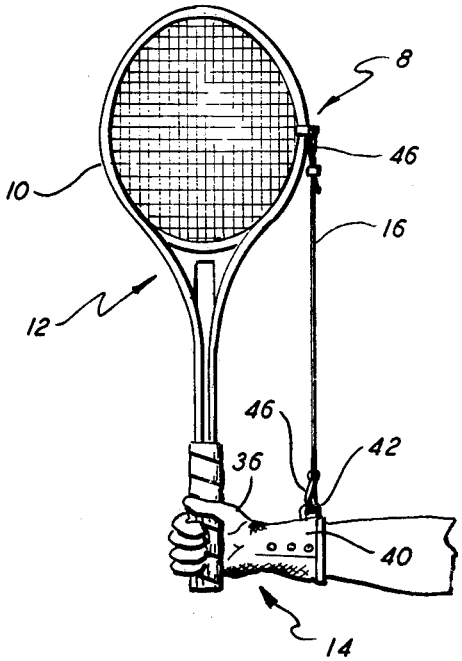
FIG. 1 is a view of a tennis training device embodying the invention as applied to the player's racquet and wrist.

Having reference now to the drawings, and with particular reference to FIG. 1, the tennis training device is essentially comprised of a fitting 8 detachably secured to the head 10 of a tennis racquet 12, a wrist engaging or wrist connection member 14 and a flexible strap member 16 detachably secured at its opposite ends to the fitting and wrist connection member. The fitting 8 is secured to one side of the racquet head, preferably at or close to its widest part.

Figure 2:
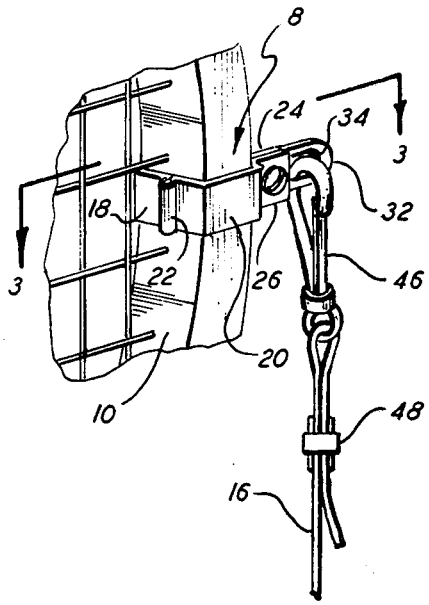
FIG. 2 is an enlarged, fragmentary, perspective view of the portion of the device that engages the racquet head.
Figure 3:
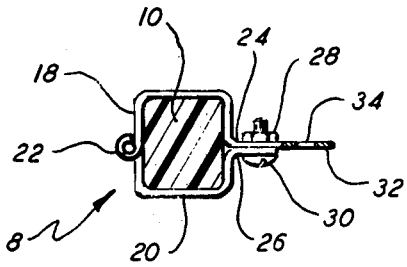
FIG. 3 is an enlarged transverse sectional view taken on line 3—3 of FIG. 2.

The fitting is adapted to encircle the racquet frame and to this end comprises two complementary half portions 18,20 that are hingedly connected at 22, FIGS. 2 and 3. Diametrically opposite the hinge connection 22, the half portions are provided with mating flanges 24,26 that are releasably connected together as by a nut and bolt, 28 and 30. One of the flanges 24 has an extension 32 having an eye 34 for connecting the fitting with strap member 16. While the fitting has been described as being detachably secured to the head of the tennis racquet, it will be understood that it could if desired be made a permanent part of the racquet as by being made integral therewith.

Figure 4:
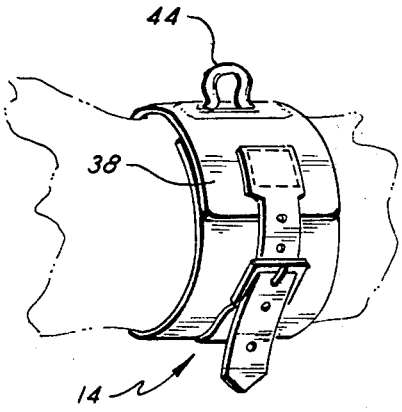
FIG. 4 is an enlarged perspective view of an alternative form of the wrist engaging portion of the device.

The wrist connection member 14 can be in the form of a glove 36 as shown in FIG. 1 or a wrist band 38 as shown in FIG. 4, both having reinforced constructions so as to be able to withstand the stresses placed upon them in hitting shots. Glove 36 has a wrist engaging cuff 40 that is provided with a securely attached ring 42 for connecting the strap member 16 to the glove. For the same purpose, the wrist band 38 is provided with a securely attached ring 44.

The strap member 16 is provided at its opposite ends with snap hooks 46 for engagement respectively with the eye 34 on the racquet fitting 8 and ring 42 or 44 on the glove or wrist band. The length of the strap member is adjustable as by means of a wedge clip 48 or the like, FIG. 2. Preferably, the strap member has limited elasticity and, to this end, it can be made of any one of a number of known materials or a combination of materials.

The training device is used as indicated in FIG. 1 with the strap member 16 extending without slack from the fitting 8 on the racquet head to the wrist connection member 14. The length of the strap member is adjusted so that the device helps the player hold the racquet in the desired angular relation to his arm and, at the same time, is comfortable for him. This is particularly beneficial to players who have not yet developed enough muscular control to easily maintain the angular relation by themselves.

In addition to helping the player hold his racquet in the proper manner, the training device retards continued forward and inward movement of the racquet after the ball has been hit and thereby greatly reduces the tendency to stretch the extensor muscles of the forearm, a cause of tennis elbow. In hitting hard shots, the device is helpful because the initial impact upon hitting the ball is largely absorbed by the elasticity of the strap member 16 and thereafter the force of the impact is transmitted by the member to the strong bone structure of the wrist.

From the foregoing description it will be apparent that the invention provides a novel and very beneficial tennis training device. As will be understood by those familiar with the art, the invention may be embodied in other specific forms without departing from the spirit or essential characteristics thereof.

I claim:

1. A tennis training device adapted to operate in conjunction with a tennis player's racquet and wrist, the device comprising a fitting mounted on the head of the racquet at approximately its widest transverse point, a wrist connection member, and a flexible strap member detachably secured at its opposite ends to said fitting and wrist connection member so as to extend therebetween, the strap member operating to aid in establishing a desired angular relation between the player's arm and the longitudinal axis of the racquet.

2. A tennis training device as defined in claim 1 wherein the wrist connection member is a wrist encircling band having means for connecting the strap thereto.

3. A tennis training device as defined in claim 1 wherein the wrist connection member is a glove having means for connecting the strap thereto.

4. A tennis training device adapted to operate in conjunction with a tennis player's racquet and wrist, the device comprising a hinged fitting detachably secured to the racquet head at approximately its widest transverse point, a connection member engaging the player's wrist, and a flexible strap having limited elasticity, the strap being detachably secured at one end to the fitting and at the other end to the connection member whereby it extends between the fitting and member and operates to aid in establishing a desired angular relation between the player's arm and the longitudinal axis of the racquet.

5. A tennis training device as defined in claim 4 wherein the length of the strap is adjustable, the strap length being adjusted so that it extends between the fitting and connection member without slack.

6. A tennis training device as defined in claim 4 wherein the connection member is a wrist encircling band having means for connecting the strap thereto.

7. A tennis training device as defined in claim 4 wherein the connection member is a glove having means for connecting a strap thereto.

* * * * *